US009123490B2

(12) United States Patent
Baron et al.

(10) Patent No.: US 9,123,490 B2
(45) Date of Patent: Sep. 1, 2015

(54) VACUUM SWITCH TUBE

(75) Inventors: Lydia Baron, Berlin (DE); Werner Hartmann, Weisendorf (DE); Roman Renz, Berlin (DE); Astrid Renz, legal representative, Berlin (DE); Ulf Schümann, Dallgow-Döberitz (DE)

(73) Assignee: Siemens Aktiengesellschaft, Munich (DE)

( * ) Notice: Subject to any disclaimer, the term of this patent is extended or adjusted under 35 U.S.C. 154(b) by 477 days.

(21) Appl. No.: 13/574,262

(22) PCT Filed: Jan. 7, 2011

(86) PCT No.: PCT/EP2011/050149

§ 371 (c)(1),
(2), (4) Date: Dec. 14, 2012

(87) PCT Pub. No.: WO2011/089034

PCT Pub. Date: Jul. 28, 2011

(65) Prior Publication Data

US 2013/0092659 A1 Apr. 18, 2013

(30) Foreign Application Priority Data

Jan. 20, 2010 (DE) ..... 10 2010 005 466

(51) Int. Cl.
*H01H 33/662* (2006.01)

(52) U.S. Cl.
CPC ..... *H01H 33/662* (2013.01); *H01H 33/66261* (2013.01); *H01H 2033/66284* (2013.01); *H01H 2033/66292* (2013.01)

(58) Field of Classification Search
CPC ..... H01H 33/66207; H01H 33/66261; H01H 33/662
USPC ..... 218/134, 136, 139
See application file for complete search history.

(56) References Cited

U.S. PATENT DOCUMENTS

| | | | | |
|---|---|---|---|---|
| 3,185,800 | A | 5/1965 | Titus | |
| 3,792,214 | A | 2/1974 | Voshall | |
| 4,088,860 | A * | 5/1978 | Abe et al. | 218/136 |
| 6,891,122 | B2 * | 5/2005 | Renz | 218/136 |

FOREIGN PATENT DOCUMENTS

| | | | |
|---|---|---|---|
| DE | 100 29 763 | B4 | 1/2009 |
| JP | 56117444 | A | 9/1981 |
| JP | 01041133 | A | 2/1989 |

OTHER PUBLICATIONS

Wang Jimei, "China University Teaching Material Vacuum Switch Theory and Application", Press of Xi'an Jiaotong University, pp. 73-76; Nov. 30, 1986—English Translation.
Liu Tao, et al: "Analysis of Influencing Factors for Electric Field Distribution of High Voltage Vacuum Interrupter", High Voltage Engineering, vol. 33, No. 1, pp. 136-139; Jan. 31, 2007—English Abstract.

* cited by examiner

*Primary Examiner* — Amy Cohen Johnson
*Assistant Examiner* — Marina Fishman
(74) *Attorney, Agent, or Firm* — Laurence A. Greenberg; Werner H. Stemer; Ralph E. Locher

(57) ABSTRACT

A vacuum switch tube has a housing which has two insulating housing regions arranged and configured symmetrically in respect of a center plane. Each of the two insulating housings contains a plurality of insulating housing parts. Shielding elements extend into the interior of the vacuum switch tube and are arranged between neighboring insulating housing parts and between insulating housing parts and neighboring additional housing parts. The shielding elements have improved dielectric properties and a simultaneously material-saving structure. Accordingly, the geometrical dimensions of the shielding elements are determined in dependence on a connected voltage and possible critical field strength between neighboring shields.

2 Claims, 1 Drawing Sheet

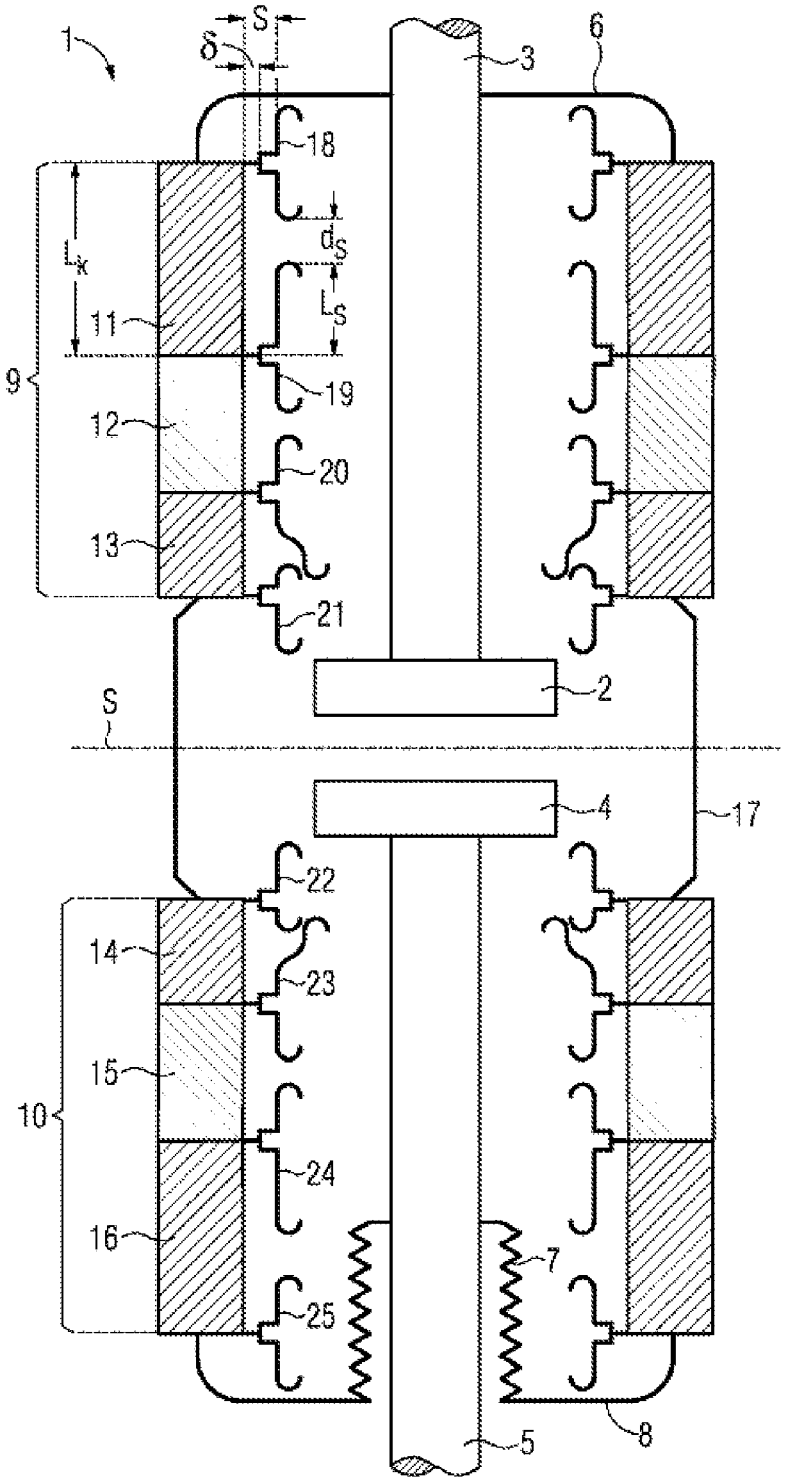
1
S
δ
3
6
18
$d_S$
$L_*$
$L_S$
11
9
19
12
20
13
21
2
S
4
17
22
14
23
15
10
24
16
7
25
5
8

VACUUM SWITCH TUBE

BACKGROUND OF THE INVENTION

Field of the Invention

The invention relates to a vacuum interrupter comprising a housing, which has two insulating housing regions formed and arranged symmetrically with respect to a central plane, each of the two insulating housings comprising a plurality of insulating housing parts, and shielding elements which extend into the interior of the vacuum interrupter being arranged between respectively adjacent insulating housing parts and between insulating housing parts and respectively adjacent further housing parts.

Such a vacuum interrupter is known, for example, from DE 100 29 763 B4. The vacuum interrupter disclosed therein has a housing with two insulating housing regions which are formed and arranged substantially symmetrically with respect to a central plane. Each of the two insulating housings comprises a plurality of insulating housing parts in the form of in each case two ceramic cylinders, shielding elements extending into the interior of the vacuum interrupter being arranged between adjacent insulating housing parts and between insulating housing parts and other housing parts of the vacuum interrupter in the form of cover parts. In this case, the shielding elements are essentially intended to shield the insulating housing parts in the form of ceramic cylinders with respect to metal vapors produced in the event of a switching operation of a contact system of the vacuum interrupter in order to maintain the insulating properties of the insulating housing parts.

BRIEF SUMMARY OF THE INVENTION

The object of the present invention is to design a vacuum interrupter of the type mentioned at the outset with improved dielectric properties with at the same time a material-saving design.

This is achieved according to the invention in the case of a vacuum interrupter of the type mentioned at the outset by virtue of the fact that geometric dimensions of the shielding elements are determined depending on a voltage applied and a possible critical field strength between adjacent shields.

By determining the dimensions depending on an applied voltage and a possible critical field strength between adjacent shields, required dielectric properties are achieved with the minimum amount of material consumption required without, firstly, shielding elements needing to be provided with excessively large dimensions. Secondly, provision is at the same time made for the dielectric properties to meet the requirements in respect of the voltage applied for the vacuum interrupter without flashovers or the like occurring between the individual shielding elements of the vacuum interrupter. The geometric dimensions in the sense of the present invention are, for example, a distance between adjacent shielding elements, a distance between a shielding element in its axial extent and the insulating housing part or a radius of curvature of a shielding element which is bent at one end.

In an advantageous configuration of the invention, shielding elements which are arranged on insulating housing parts which are arranged furthest removed from a contact system of the vacuum interrupter have a distance s from the insulating housing part and a distance $d_s$ with respect to one another at their ends having a radius of curvature R, where s, $d_s$ and R $$\frac{\Delta U_{max}}{d_s} \cdot \sqrt[3]{\left[1+\left(\frac{d_s}{\varepsilon_r \cdot s}\right)^2\right] \cdot \frac{d_s}{R}} \leq E_{crit}$$

according to adhere to a maximum voltage difference $\Delta U_{max}$ at the furthest removed insulating housing part and a critical field strength, the critical field strength resulting from field computations of the vacuum interrupter, and the maximum voltage difference $\Delta U_{max}$ resulting from $$\Delta U_{max} = \Delta U(N) \approx \frac{(3N-2) - 4\alpha \cdot (N-1)}{N^2} \cdot U$$

where $\alpha$: Coupling factor from field computations and $\epsilon_r$: Dielectric constant of the insulating housing part depending on the number of insulating housing parts.

Such a design of the shielding elements arranged furthest removed from the contact system of the vacuum interrupter has, in a series of experiments and computations, resulted as an optimum geometric configuration of the distances between the shielding elements and between the shielding elements and the ceramic and of the design of the radii of curvature because an electrical potential distribution which is set in the axial direction along the vacuum interrupter and therefore the dielectric strength, which is dependent on both the geometry of the interrupter and the capacitive couplings to external conditions, such as ground potential or grounded housings of a switching device in which the vacuum interrupter is arranged, for example, wherein the insulating housing parts arranged at one end of the vacuum interrupter and the shielding elements arranged thereon have the greatest potential difference. The coupling vector a in this case indicates how the voltage across the vacuum interrupter is set or in particular what proportion constitutes the voltage drop across the insulting housing parts closest to the contact system.

In a further advantageous configuration of the invention, in order to shield a triple-junction point, each shielding element extends radially into the interior of the vacuum interrupter in the region of the point at which said shielding element is connected to the insulating housing part at a distance $\delta$ from the insulating housing part wherein $\delta$ is determined by the relationships $$\frac{s}{\varepsilon_r} < \delta < 0.75 \cdot s \text{ and } 3 \cdot \delta < L_s < 0.5 \cdot L_K$$

where $\epsilon_r$: Dielectric constant of the insulating housing part $L_S$: proportional shielding length $L_K$: length of the insulating housing part.

Given such a configuration in the region of the connection point between the shielding element and the insulating housing part, optimum negative control of the electrical field in the triple-junction point is provided. The triple junction in the sense of the present invention is in this case any connection region of the vacuum interrupter at which insulating housing parts, shielding elements and vacuum adjoin one another.

BRIEF DESCRIPTION OF THE SEVERAL VIEWS OF THE DRAWING

The single FIGURE of the drawing is an illustration of a vacuum interrupter according to the invention.

DESCRIPTION OF THE INVENTION

The invention will be explained in more detail using an exemplary embodiment with reference to the attached drawing, in which a single FIGURE shows an exemplary embodiment of a vacuum interrupter according to the invention.

The FIGURE shows a vacuum interrupter 1 with a contact system comprising a fixed contact 2 with a fixed contact connection pin 3 and a moving contact 4 and a moving contact connection pin 5. The fixed contact connection pin 3 is passed out of the vacuum interrupter in vacuum-tight fashion through a metal housing part in the form of a cover part 6 in order to connect to current-conducting parts of a switchgear assembly (not illustrated in FIGURES), in the same way as the moving contact connection pin 5 is passed out of the vacuum interrupter 1 by means of a bellows 7 in vacuum-tight fashion and movably through a further metal housing part 8 in the form of a second cover part. The contact system with the moving contact 4 and the fixed contact 2 is intended to switch or interrupt a current conducted via the vacuum interrupter, wherein a drive movement of a drive (not illustrated in the FIGURES) for switching or interrupting the contact system can be introduced via the moving contact connection pin 5. The vacuum interrupter has a first insulating housing region 9 and a second insulating housing region 10, the first insulating housing region 9 being constructed from insulating housing parts 11, 12 and 13 in the form of ceramic cylinders, and the second insulating housing region 10 being constructed from insulating housing parts 14, 15 and 16, likewise in the form of ceramic cylinders, and a further metal housing part in the form of a metal chamber 17 being arranged between the first insulating housing region 9 and the second insulating housing region 10. With respect to a central plane S, the vacuum interrupter 1 is substantially symmetrical with respect to its housing. Shielding elements 18 to 25, which extend into the interior of the vacuum interrupter, are arranged in each case between adjacent insulating housing parts and between the metal housing parts 6 and 8 and the respective adjacent insulating housing parts thereof. The shielding elements 18 to 25 are configured in such a way that their geometric dimensions are determined depending on an applied voltage and a possible critical field strength between adjacent shields, as will be explained in more detail below.

In the case of a disconnected contact system, as illustrated in the FIGURE, with mutually spaced-apart fixed and moving contacts, a potential distribution is set across the vacuum interrupter, which potential distribution is dependent on both the geometry of the vacuum interrupter and capacitive couplings to external conditions, for example ground potential or grounded housings of the switchgear assembly (not illustrated in the FIGURES). This potential distribution is critical for the dielectric strength of the vacuum interrupter. The potential distribution therefore also results in different potential differences between adjacent shielding elements, the shielding elements on the respectively furthest removed insulating housing part having the greatest potential difference.

Simulations and field computations result in a relationship with the total applied voltage for the shielding elements arranged closest to the contact system, as follows:

$$U_s=\alpha\cdot U$$

where $\alpha$ is a coupling factor which results from field computations and which can assume the value 0.3, for example for a vacuum interrupter with four insulating housing parts, depending on external conditions.

Approximately the following relationship results empirically for the potential difference between the n-th and the (n−1)th shielding element (n=2, 3, . . . N):

$$\Delta U(n) \approx \frac{(4n-2-N)+4\alpha\cdot(N-2n+1)}{N^2}\cdot U,$$

with the result that a maximum voltage at a shielding element (n=N) arranged furthest removed from the contact system results as:

$$\Delta U_{max} = \Delta U(N) \approx \frac{(3N-2)-4\alpha\cdot(N-1)}{N^2}\cdot U.$$

For example, in the case of a vacuum interrupter with four insulating housing parts with a coupling factor of $\alpha$=0.3, the following results for the maximum voltage difference:

$$\Delta U_{max}=0.4\cdot U.$$

In other words, the maximum voltage difference which results across an insulating housing part arranged furthest removed from the contact system and therefore between the shielding elements arranged on said insulating housing part is approximately 40% of the total voltage applied across the vacuum interrupter in the case of a disconnected contact system, in a vacuum interrupter with four insulating housing parts and a coupling factor resulting from the external conditions of $\alpha$=0.3.

This maximum voltage difference and the critical field strength resulting from field computations, which critical field strength is dependent on material and surface area and assumes typical values of between 20 kV and 50 kV per mm, need to be taken into consideration in the determination of the geometric dimensions of the shielding elements on the insulating housing part furthest removed such that the following relationship is maintained between the radius of curvature R of rounded-off ends of the shielding elements, a distance s from the shielding element to the insulating housing part and a distance $d_s$ between the ends of adjacent shielding elements:

$$\frac{\Delta U_{max}}{d_s}\cdot\sqrt[3]{\left[1+\left(\frac{d_s}{\varepsilon_r\cdot s}\right)^2\right]\cdot\frac{d_s}{R}} \le E_{crit}$$

In this case, $\epsilon_r$ is the dielectric constant of the insulting housing part.

Furthermore, a minimum distance $\delta$ needs to be maintained in the region of the so-called triple-junction point, i.e. the connection point at which the insulating housing part, the metal housing part or the shielding element and the vacuum adjoin one another, this distance being the distance in which the shielding element extends radially away from the insulting housing part, where the following relationships should be fulfilled for the distance $\delta$:

$$\frac{s}{\varepsilon_r} < \delta < 0.75\cdot s \text{ and } 3\cdot\delta < L_s < 0.5\cdot L_K$$

In this case, $L_S$ is the shielding length with which the shielding element extends in the axial direction of the vacuum interrupter, and $L_K$ is the length of the insulating housing part, as illustrated in the exemplary embodiment shown in FIG. 1 using the shielding element 19 and the ceramic 11. In the region of the shielding elements which are arranged closest to the contact system comprising the fixed contact 2 and the moving contact 4, in the exemplary embodiment in FIG. 1 the shielding elements 20 and 21, on the basis of the above relationship the potential differences which are set are markedly lower, with the result that the required distances between the shielding elements 20 and 21 are smaller, and an overlap in the axial direction between these shielding elements 20 and 21 is made possible, in order to shield, as effectively as possible, geometric shading of the insulating housing part 13 from evaporation by metal vapor produced during a switching operation on disconnection of the contact system comprising the fixed contact 2 and the moving contact 4, in order to maintain the insulating property of the insulating housing part 13.

LIST OF REFERENCE SYMBOLS

1 Vacuum interrupter
2Fixed contact
3 Fixed contact connection pin
4 Moving contact
5 Moving contact connection pin
6 Metal cover part
7 Bellows
8 Metal cover part
9 First insulating housing region
10 Second insulating housing region
11 to 16 Insulating housing parts
17 Metal housing part
18 to 25 Shielding elements
S Central plane

The invention claimed is:

1. A vacuum interrupter, comprising:

a housing having two insulating housing regions formed and disposed symmetrically with respect to a central plane, each of said two insulating housing regions having a plurality of insulating housing parts and further housing part;

shielding elements extending into an interior of the vacuum interrupter and disposed between respectively adjacent ones of said insulating housing parts and between said insulating housing parts and respectively adjacent ones of said further housing parts, said shielding elements having geometric dimensions determined depending on a voltage applied and a critical field strength between adjacent ones of said shielding elements, said shielding elements having bent ends, said geometric dimensions selected from the group consisting of a distance $d_s$ between ends of adjacent ones of said shielding elements, a distance S between a respective one of said shielding elements along an axial extent and one of said insulating housing parts and a radius of curvature R of said bent ends of said shielding elements;

a contact system; and said shielding elements disposed adjacent said insulating housing parts disposed furthest removed from said contact system have the distance S from said insulating housing parts and the distance $d_s$ with respect to one another and at their ends having the radius of curvature R, where S, $d_s$ and R according to $$\frac{\Delta U_{max}}{d_s} \cdot \sqrt[3]{\left[1 + \left(\frac{d_s}{\varepsilon_r \cdot s}\right)^2\right] \cdot \frac{d_s}{R}} \leq E_{crit}$$

adhere to a maximum voltage difference $\Delta U_{max}$ at said furthest removed insulating housing part and the critical field strength, the critical field strength resulting from field computations of the vacuum interrupter, and the maximum voltage difference $\Delta U_{max}$ resulting from $$\Delta U_{max} = \Delta U(N) \approx \frac{(3N-2) - 4\alpha \cdot (N-1)}{N^2} \cdot U$$

where $\alpha$: is a coupling factor being a measure of what proportions constitutes a voltage drop across said insulating housing parts closest to said contact system, and $\epsilon_r$: is a dielectric constant of said insulating housing part depending on a number of said insulating housing parts.

2. The vacuum interrupter according to claim 1, wherein in order to shield a triple-junction point, each of said shielding elements extends radially into said interior of the vacuum interrupter in a region of a point at which said shielding element is connected to said insulating housing part at a distance $\delta$ from said insulating housing part, wherein $\delta$ is determined by the relationship:

$$\frac{s}{\varepsilon_r} < \delta < 0.75 \cdot s \text{ and } 3 \cdot \delta < L_s < 0.5 \cdot L_K$$

where $\epsilon_r$: is a dielectric constant of said insulating housing part;

$L_S$: is a proportional shielding length; and $L_K$: is a length of said insulating housing part.

* * * * *